US005319425A

United States Patent [19]

Forlani

[11] Patent Number: 5,319,425

[45] Date of Patent: Jun. 7, 1994

[54] FIXING DEVICE FOR IMPROVING THE FLATNESS OF SHEETS DISCHARGED THEREFROM

[75] Inventor: Riccardo Forlani, Turin, Italy

[73] Assignee: Olivetti-Canon Industriale S.p.A., Ivrea, Italy

[21] Appl. No.: 971,231

[22] Filed: Nov. 4, 1992

[30] Foreign Application Priority Data

Nov. 5, 1991 [IT] Italy ..... TO 91A000832

[51] Int. Cl.[5] ..... G03G 15/20

[52] U.S. Cl. ..... 355/285; 355/290

[58] Field of Search ..... 355/282, 285, 290; 219/216; 162/271

[56] References Cited

U.S. PATENT DOCUMENTS 5,091,752 2/1992 Okada ..... 355/285
5,148,226 9/1992 Setoriyama et al. ..... 355/290
5,162,634 11/1992 Kusaka et al. ..... 219/216

*Primary Examiner*—A. T. Grimley
*Assistant Examiner*—Nestor R. Ramirez
*Attorney, Agent, or Firm*—Banner, Birch, McKie & Beckett

[57] ABSTRACT

Fixing device for copying machines in which a linear heating element, positioned transversely to the movement of the sheet of paper, is immediately followed by a shoulder projecting beyond the heating element towards a pressure roll in order to give the paper an opposite curl to that spontaneously adopted. The sheets of paper emerge from the fixing device having retained their flat form. Because of the high specific pressure on the shoulder fixing is improved.

7 Claims, 3 Drawing Sheets

"PRIOR ART"

FIXING DEVICE FOR IMPROVING THE FLATNESS OF SHEETS DISCHARGED THEREFROM

BACKGROUND OF THE INVENTION

The present invention relates to a fixing device for improving the flatness of sheets of paper or similar information supports carrying a toner developed image fixed through the fixing device and for eliminating the spontaneous curling of sheets discharged therefrom.

In conventional copying machines a-straight heating element is arranged perpendicularly to the forwarding direction of the sheets of paper or information supports and is fixed on a heat refractory support. A belt-type transport element is positioned between the heating element and the face of the sheet of paper or information support on which a toner powder image has been deposited and a pressure roll is pressed against the back of the information support. The heat and pressure fix the toner powder image to the sheet of paper or information support.

In such copying machines the sheets tend to curl as they emerge from the fixing device as a result of the application of the heat to one face of the sheet.

Devices for eliminating the curling of paper sheets emerging from a fixing unit in a copying machine are well known. In particular our European Patent Application Number EP-A No. 0485123 discloses that forwarding rolls may be positioned downstream of the fixing unit. These rolls pull the sheet in the opposite direction to the preferred direction of curling of the sheet as it emerges from the fixing unit. This device is, however, large and expensive owing to the large number of components required.

SUMMARY OF THE INVENTION

A preferred embodiment of the present invention provides a fixing device for a copying machine in which a linear heating element is positioned transversely to the direction of movement of sheets in the copying machine. This heating element is immediately followed by a shoulder projecting beyond the heating element and over which sheets must pass as they emerge from the fixing device. This shoulder gives the sheets an opposite curl to that which they would adopt as a result of the heating of one face. Thus sheets emerge having retained their original flat form.

The invention is defined with more precision in the appended claims to which reference should now be made.

BRIEF DESCRIPTION OF THE DRAWINGS

This and other features of the invention will be made clearer by the following description of a preferred embodiment with reference to the accompanying drawings, in which.

DETAILED DESCRIPTION OF A PREFERRED EMBODIMENT

Figure 1:
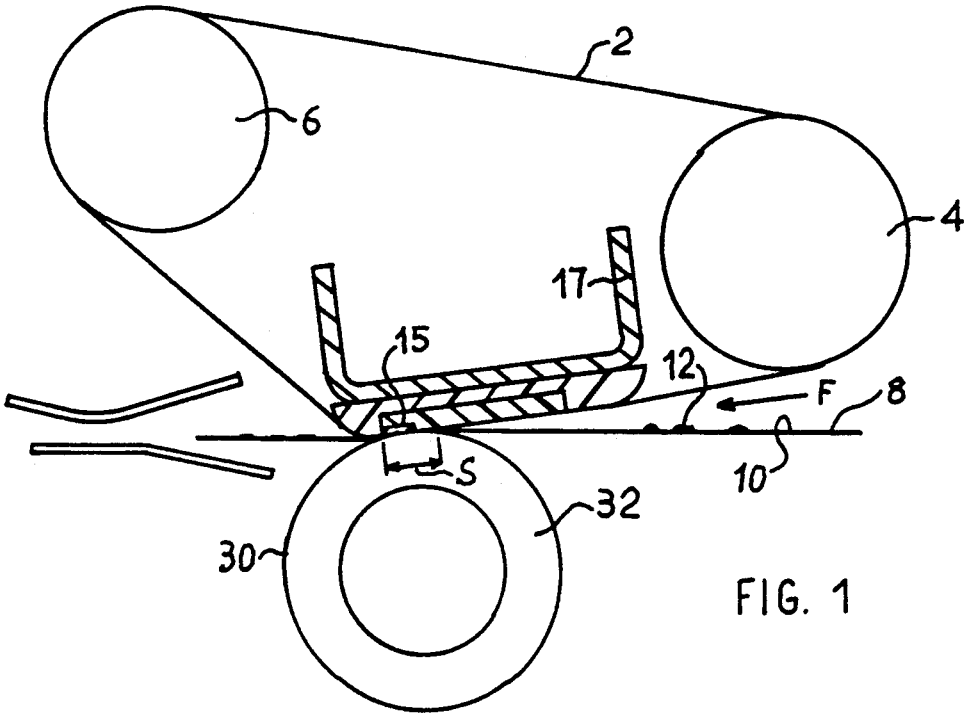
FIG. 1 is a diagramatic view of a fixing device for copying machines embodying the invention.

Referring to FIG. 1, an endless belt-type transport element 2 passes around two forwarding rolls 4 and 6.

The belt 2 preferably consists of a thin sheet of Mylar (registered trade mark) some 75 μm thick, driven in the direction F by the drive roll 4, to forward a sheet 8 on whose upper face 10 a toner powder image 12 is deposited which must be fixed by heat and pressure to the sheet 8. A beating element 15 is fixed to an underside of a support 17 located inside the belt 2.

The heating element 15 consists of a strip of resistive material 1.5–3 mm wide measured in the forwarding direction of the belt 2. The length of the element 15, measured perpendicularly to the forwarding direction is generally greater than the maximum format of sheets handled by the copier.

Figure 2:
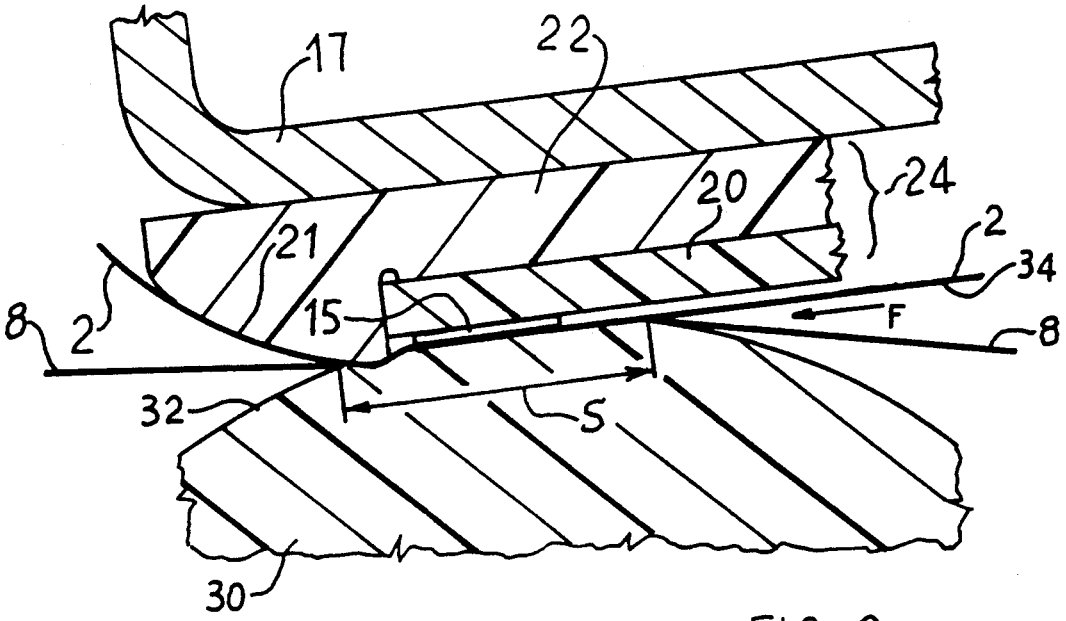
FIG. 2 is an enlarged detail from FIG. 1.

The element 15 (FIG. 2) is deposited by a screen printing process on an alumina plate 20 approximately 1–2 mm thick which in turn is embedded in a base 22 of a heat-resistant resin such as PEEK (Polyetheretherketone) or LCPs (liquid-crystal polymers). The plate 20 and base 22 form a block 24.

The resin forming the base 22 must retain its physical and mechanical characteristics unaltered up to a temperature of at least 280° C. and in particular at this temperature must retain high resistance to wear and to concentrated loads.

The block 24 is fixed in some suitable manner to the metal support 17 forming part of the-frame of the copier.

A pressure roll 30 is kept pressed against the belt 2 to keep it in contact with the block 24, with a total load of about 8 kg.

The roll 30 comprises an outer layer 32 of soft heat-resistant rubber which adheres to the outer surface 34 of the belt 2 over a contact area or strip S whose width is between 4 and 6 MM. The width of the strip S is measured in the forwarding direction of the belt 2 indicated by F.

The base 22 projects beyond the plate 20 in the direction of movement of the belt 2, with a curved profile 21 whose generous curvature is in the opposite direction to the curvature of the roll 30, hence moving away from the outer surface 32 of the roll 30. The profile 21 accompanies the belt 2 in its movement towards the roll 6.

Owing to the motion of the belt 2 in the direction F, a sheet 8 is drawn between the roll 30 and the belt 2, with the toner powder on its upper surface 10.

The heat transmitted by the element 15 through the belt 2 softens the toner powder which sticks to the sheet 8.

Figure 3:
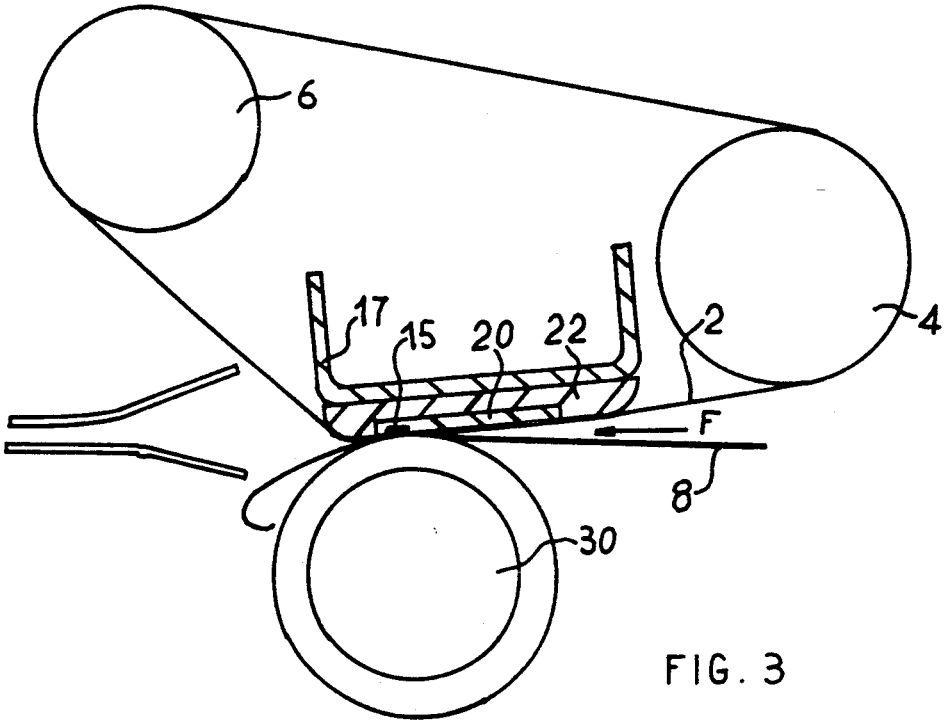
FIG. 3 illustrates the spontaneous curling of a sheet as it emerge from the device shown in FIG. 1.

Because of the heat of fixing, the sheet 8 emerging from the area S would tend spontaneously to roll up on itself following the curvature of the roll 30 as indicated in FIG. 3.

Figure 4:
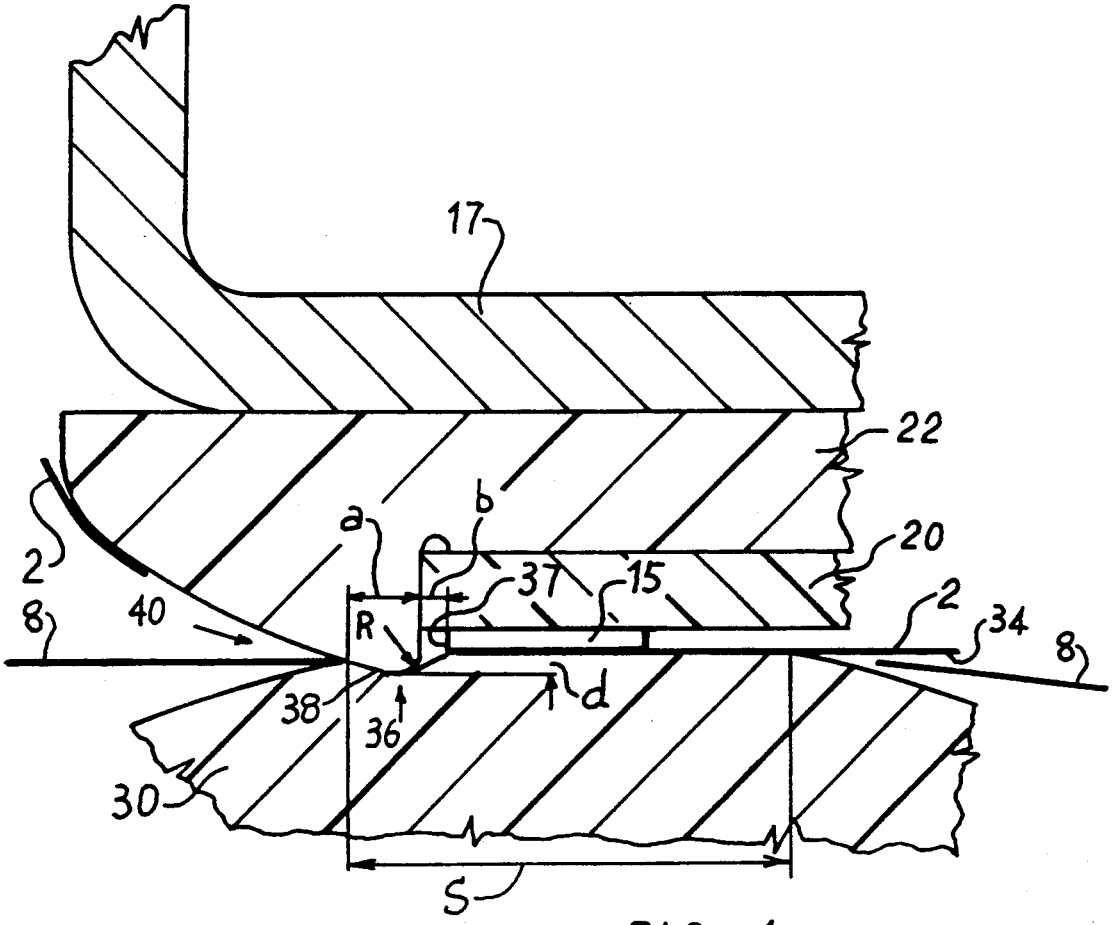
FIG. 4 is an enlarged view of a detail from FIG. 2.

To counter this problem, the resin base 22 is constructed so as to comprise a shoulder 36 (FIG. 4) which projects towards the roll 30 away from the surface of contact 34 between the roll 30 and the belt 2. The shoulder 36 is located immediately beyond the leaving edge 37 of the element 15 in the direction F at a distance "b" typically in the range 0 to 2.5 mm, and preferably between 0.1 and 0.3 mm the optimum of "b" being 0,2 mm.

The shoulder 36 is manufactured to a curved surface having a curved profile 38 whose radius of curvature R is typically between 0.1 and 0.3 mm and preferably equal to 0.2 mm and extends perpendicularly to the plane of the figures over a length equal to the length of the element 15.

The shoulder 36 projects away from the surface 34 by a good amount "d", typically 0.1–0.3 mm, and preferably equal to 0.2 mm.

The length of the shoulder 36 is greater than the width of a sheet of the maximum format that can be used through the fixing device 2, 15, 30.

The roll 30 is positioned relative to the block 24 (FIG. 2) such that the area of contact S completely covers the shoulder 36 and extends beyond it by an amount "a" (FIG. 4) of length typically in the range 0.5–1.5 mm. The compression of the rubber layer 32 of the roll 30 forces the belt 2 to adhere along the profile 38 of the shoulder 36. Thus when a sheet is passing through the fixing device it is pressed between the roll 30 and the belt 2 in the contact area S and is therefore forced to curve in the direction of the curvature of the profile 38 of the shoulder 36.

The heating element is located close to the leaving edge 40 of the plate 22 in the forwarding direction of the belt 2 indicated by F.

This arrangement of the heating element 15 achieves the following advantages simultaneously:

the still hot sheet is curved in the opposite direction to the curl is would spontaneously adopt in the absence of the shoulder 36. This spontaneous curling is thus automatically eliminated and the sheet merges from the fixing device in a generally flat form;

the toner is still partically softened when the sheet 8 passes against the shoulder 36, so that owing to the high specific pressure along the profile 38 due to the compression of the roll 30, the toner is powerfully and permanently caused to penetrate deeply between the fibres of the paper of the sheet 8, so that the image stays fixed indelibly on the paper.

The base 22 may alternatively be made from a good heat-conducting metal such as aluminium, copper, bronze or titanium.

The projection 36 may also be protected by covering it with a thin protective layer of, for example, Teflon (TM) or a ceramic material.

Figure 5:
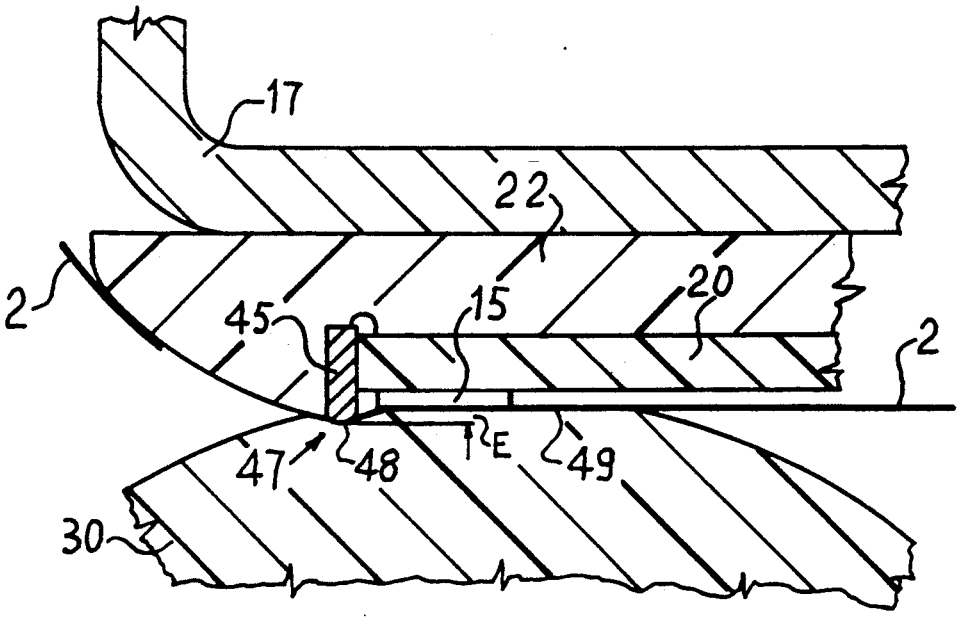
FIG. 5 shows a variant of the base shown in FIG. 2.

The projection 36 may also be made by using (FIG. 5) a metal element 45 inserted between the plate 20 and the base 22.

The element 45 is approximately 0.2 mm thick and ends in a bottom edge 47 having a curved profile 48 whose radius of curvature is between 0.1 and 0.3 mm and preferably equal to 0.2 mm.

In this case the element 45 will appropriately be made of aluminium and the edge 47 may be covered by a thin protective layer of ceramic material. The edge 47 of the element 45 must project from the lower surface 49 of the belt 2 by an amount "E" of approximately 0.1–0.2 mm, preferably equal to 0.2 mm.

Figure 6:
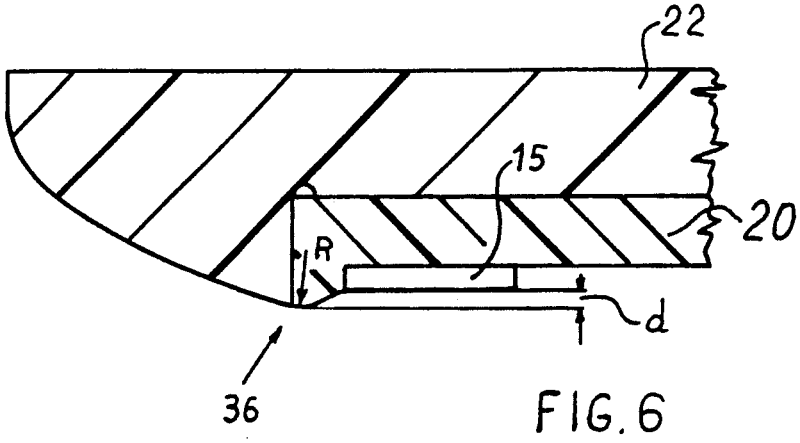
FIG. 6 shows a structural variant of the shoulder shown in FIG. 1.

It will be understood that modifications of shape, additions or substitutions of parts may be made to the fixing device of the invention without thereby departing from the scope of the present invention. For example (FIG. 6) the shoulder 36 is constructed directly on the plate 20 and is located immediately downstream of the heating element.

I claim:

1. A fixing device for improving the flatness of sheets discharged therefrom in a discharge direction, comprising:

a heat resistant support;

a heating element fixed on said heat resistant support and arranged across said discharge direction;

a transport belt element positioned in sliding contact with said heating element;

a pressure roll urged against said transport element, said heating element and said support thereby defining a contact area between said belt element, said heating element and said support;

said roll and said belt element being moved tangentially together in order to draw said sheets through said fixing device in said discharge direction; and a shoulder carried on said heat resistant support and projecting beyond said heating element towards said pressure roll, said shoulder being located adjacent to and downstream of said heating element in said discharge direction of said sheets;

wherein said pressure roll forms said contact area compressed against said heating element having a width (S) which covers and extends beyond said shoulder, whereby sheets which have passed said heating element are pressed between said roller and said shoulder, so that they are bent in a direction opposite to their natural direction of curl, having retained the original flat form.

2. A fixing device for improving the flatness of sheets discharged therefrom in a discharge direction, comprising:

a heating element fixed on a support; and a pressure roll urged against said heating element and said support, thereby defining a contact area;

said support having a shoulder projecting towards said pressure roll, said shoulder being located adjacent said heater element within said contact area downstream of said heating element in said discharge direction, whereby sheets which are pressed between said roller and said shoulder are bent in a direction opposite to their natural direction of curl, having retained the original flat form.

3. In a fixing apparatus of a copying machine for indelibly fixing images on sheets by pressure and heat, comprising:

a heat resistant support;

a heating element fixed on said heat resistant support and arranged across a discharge direction of said sheets from the apparatus;

a transport belt element positioned in contact with said heating element;

a pressure roll urged against said transport belt element, said heating element and said support thereby defining a contact area between said pressure roll and said transport belt element; and said roll and said belt element being moved tangentially together in order to draw said sheets through said fixing device in said discharge direction, the improvement comprising a device for improving the flatness of the sheets discharged from said fixing apparatus in said discharge direction, including a shoulder adjacent said heating element and projecting towards said pressure roll, said shoulder being located within said contact area immediately beyond the leaving edge of said heating element in said discharge direction, whereby sheets which have passed said heating element are bent in a direction opposite to their natural direction of curl, having retained the original flat form.

4. A fixing device as claimed in claim 1, 2, or 3, wherein said shoulder extends in a straight line parallel to said heating element and is positioned at a distance of between 0 and 2.5 mm from said heating element in said discharge direction.

5. A fixing device as claimed in claim 4, wherein said distance is preferably between 0.1 and 0.3 mm from said heating element.

6. A fixing device as claimed in claim 4, wherein said contact area extends beyond said shoulder in said discharge direction by an amount of 0.5 to 1.5 mm.

7. A fixing device according to claim 4 wherein said heating element is fixed on a refractory plate fastened to said support and is positioned close to an edge of said plate.

* * * * *